US006859953B1

(12) United States Patent
Christensen

(10) Patent No.: US 6,859,953 B1
(45) Date of Patent: Mar. 1, 2005

(54) JET PROPULSION SYSTEM FOR SPA OR JETTED BATH USING CONTROL OF AIR DRAW TO VENTURI JETS WITH A THREE-WAY AIR CONTROL VALVE

(76) Inventor: Steven E. Christensen, 7944 Seneca Way, Antelope, CA (US) 95843

( * ) Notice: Subject to any disclaimer, the term of this patent is extended or adjusted under 35 U.S.C. 154(b) by 0 days.

(21) Appl. No.: 10/242,816

(22) Filed: Sep. 13, 2002

(51) Int. Cl.[7] ..... A47K 3/00
(52) U.S. Cl. ..... 4/541.1; 4/541.5
(58) Field of Search ..... 4/541.1–541.6

(56) References Cited

U.S. PATENT DOCUMENTS

| | | | | | |
|---|---|---|---|---|---|
| 3,970,111 | A | | 7/1976 | Brune et al. | 137/627.5 |
| 3,989,063 | A | | 11/1976 | Brouwers et al. | 137/596.17 |
| 4,118,074 | A | | 10/1978 | Solt | 302/26 |
| 4,119,686 | A | | 10/1978 | Conger, IV | 261/77 |
| 4,139,001 | A | | 2/1979 | Macabee | 128/64 |
| 4,237,879 | A | | 12/1980 | Genese | 128/214 G |
| 4,298,360 | A | | 11/1981 | Poll | 55/273 |
| 4,320,541 | A | | 3/1982 | Neenan | 4/492 |
| 4,325,149 | A | * | 4/1982 | Moreland | 4/541.5 |
| 4,331,459 | A | | 5/1982 | Copley | 55/302 |
| 4,359,330 | A | | 11/1982 | Copley | 55/273 |
| 4,364,751 | A | | 12/1982 | Copley | 55/96 |
| 4,419,141 | A | | 12/1983 | Kunkel | 134/22.12 |
| 4,542,854 | A | | 9/1985 | Mathis | 239/587 |
| 4,679,545 | A | | 7/1987 | Cavestany | 126/350 R |
| 4,858,255 | A | | 8/1989 | Haisman | 4/544 |
| 4,896,384 | A | | 1/1990 | Dijkhuizen | 4/542 |
| 4,922,966 | A | | 5/1990 | Kaes et al. | 137/627.5 |
| 4,955,539 | A | | 9/1990 | Ruttenberg | 239/1 |
| 5,063,620 | A | | 11/1991 | Mersmann | 4/542 |
| 5,153,949 | A | | 10/1992 | Karlsson | 4/541.4 |
| 5,172,754 | A | | 12/1992 | Graber et al. | 165/47 |
| D341,542 | S | | 11/1993 | Wild et al. | D10/49 |
| D348,922 | S | | 7/1994 | Thrasher et al. | D23/233 |
| 5,441,080 | A | | 8/1995 | Baumann | 137/625.46 |
| 5,733,441 | A | | 3/1998 | Ko et al. | 210/90 |
| 5,742,954 | A | * | 4/1998 | Idland | 4/541.1 |
| 5,819,783 | A | | 10/1998 | Blatt et al. | 137/271 |
| 5,829,069 | A | | 11/1998 | Morgan et al. | 4/493 |
| 5,850,640 | A | | 12/1998 | Pinciaro | 4/541.6 |
| 5,881,403 | A | | 3/1999 | Moreland | 4/541.1 |
| 5,893,180 | A | | 4/1999 | Moreland | 4/541.1 |
| 5,920,925 | A | | 7/1999 | Dongo | 4/541.6 |
| 5,928,171 | A | | 7/1999 | Larsen | 601/148 |
| 5,943,711 | A | | 8/1999 | Loizeaux et al. | 4/541.6 |
| 5,983,416 | A | * | 11/1999 | Idland | 4/541.1 |
| 6,003,166 | A | | 12/1999 | Hald et al. | 4/541.1 |
| 6,009,574 | A | | 1/2000 | Moreland | 4/541.5 |
| 6,052,844 | A | | 4/2000 | Walsh et al. | 4/541.1 |
| 6,161,506 | A | | 12/2000 | Hanson | 122/18.3 |
| 6,209,806 | B1 | | 4/2001 | Pace et al. | 239/585.5 |
| 6,269,703 | B1 | | 8/2001 | Bowers | 73/863.12 |
| 6,328,222 | B1 | | 12/2001 | Warner et al. | 239/5 |
| 6,378,385 | B1 | | 4/2002 | Bowers | 73/863.12 |
| 6,470,508 | B2 | * | 10/2002 | Turner | 4/541.1 |

* cited by examiner

*Primary Examiner*—Gregory L. Huson
*Assistant Examiner*—Huyen Le
(74) *Attorney, Agent, or Firm*—Lloyd W. Sadler

(57) ABSTRACT

A air selection control valve and assembly capable of controlling the flow of air into a water conduit to accelerate, decelerate, or pulse the rate of water flowing in combination with a hot tub spa assembly is described. This invention makes use of the control of the air inlet to control the pulsing of water. This invention also describes an innovative multi-way control valve system that can be controlled by as few as a single solenoid for pulsing some or all of the jets of a standard hot tub spa.

15 Claims, 8 Drawing Sheets

JET PROPULSION SYSTEM FOR SPA OR JETTED BATH USING CONTROL OF AIR DRAW TO VENTURI JETS WITH A THREE-WAY AIR CONTROL VALVE

BACKGROUND OF INVENTION

1. Field of the Invention

This invention relates to the control and production of a jet of water in a spa or hot tub or the like. More specifically, this invention relates to a device and system for controlling the flow of air added to a stream of water to create a pulsation effect in a spa or jetted bath by intermittently blocking and unblocking the flow of air drawn into one or more Venturi jets.

2. Description of Related Art

A variety of techniques are known for adding air to the water flow in a spa. Generally, a two-way system is used for this purpose. In addition, it is typical in present spas to control the pulsing of the jetted air-water stream by opening or closing the flow of water.

Although these documents are not necessarily prior art to this invention, the reader is referred to the following publications for general background material. Each of these documents is hereby incorporated by reference in its entirety for the material contained therein.

U.S. Pat. No. 6,378,385, entitled Pulsed Air Sampler, which describes a device that samples chemicals absorbed to a surface by applying a pulse of fluid to desorb the particles adhered to the surface.

U.S. Pat. No. 6,328,222, entitled Pulse Air Assist Valve Module, which describes a fuel injector for use in an internal combustion engine.

U.S. Pat. No. 6,269,703, entitled Pulsed Air Sampler, which describes a device that samples chemicals absorbed to a surface by applying a pulse of fluid to desorb the particles adhered to the surface.

U.S. Pat. No. 6,209,806, entitled Pulsed Air Assist Fuel Injector, which describes a fuel injector having a pulsed air assist atomizer to provide improved atomization and fuel spray targeting.

U.S. Pat. No. 6,161,506, entitled Pulsed Air Combustion High Capacity Boiler, which describes a pulsed combustion having high capacity boiler inlet flapper valves at an inlet air decoupler toward a combustion chamber.

U.S. Pat. No. 6,052,844, entitled Whirlpool Bath Assembly which describes a whirlpool bath assembly with a recirculation pump fed from the bath by a suction pipe and then to Venturi jet units through by system feed pipes.

U.S. Pat. No. 6,009,574, entitled Method and Apparatus for Providing a Pulsed Water Message, which describes a pulsing valve for routing water, flow from an inlet line to outlet lines connected to water jets arranged in an array to provide a message.

U.S. Pat. No. 6,003,166 entitled Potable Spa, which describes a spa having a bath with an upstanding wall and pump assembly mounted to the wall.

U.S. Pat. No. 5,943,711, entitled Gattling Jet, which describes a jet for use in spas and hydrotherapeutic reservoirs having different aligned sets of jet nozzles.

U.S. Pat. No. 5,928,171, entitled Neck Jet Pillow for Tub Spas, which describes a unitarily molded pillow for mounting in a spa and having a flexible membrane positioned therein.

U.S. Pat. No. 5,920,925, entitled Pulsating Hydrotherapy Jet System, which describes a jet, a rotating member, and a diverter cap formed with a number of, bore holes positioned at a common radius from the center of the cap.

U.S. Pat. No. 5,893,180, entitled Method and Apparatus for Providing a Pulsed Water Message that describes a pulsing valve for routing water flow from an inlet line to outlet lines connected to water jets arranged in an array to provide a message.

U.S. Pat. No. 5,881,403, entitled Method and Apparatus for Providing a Pulsed Water Message that describes a pulsing valve for routing water flow from an inlet line to outlet lines connected to water jets arranged in an array to provide a message.

U.S. Pat. No. 5,850,640, entitled Hydrotherapy Jet and Fixtures for Spa Tubs and Pools and a Method of Installation, which describes a hydrotherapy jet assembly including a resilient grommet and a jet valve body.

U.S. Pat. No. 5,829,069, entitled Jet Bath Having Multiple Accessories, which describes a jet bath designed to use minimum water and to have pulsating and massaging air-water jets appropriately located in the tub.

U.S. Pat. No. 5,819,783, entitled Modular 3-Way Valve with Manual Override, Lockout, and Internal Sensors, which describes an apparatus that selectively supplies a source of pressurized fluid to a load device and selectively exhausts pressurized fluid from the load device.

U.S. Pat. No. 5,441,080, entitled Eccentrically Rotatable Sleeve Type 3-Way Valve which describes a housing having a central, vertical bore retaining therein a flexible, tubular sleeve whose central portion can be eccentrically motivated towards or away from two opposite valve seats.

U.S. Pat. No. 5,172,754, entitled Heat Exchanger for Recovery of Heat from a Spa or Hot Tub Motor that describes a heat exchange coil for heating water in a spa or hot tub by transferring heat generated by an electric motor driving a pump to the water in the coil.

U.S. Pat. No. 5,153,949, entitled Pump Arrangements for Hydro massage Baths, which describes a pump arrangement for hot tubs including a centrifugal pump having a central inlet and a radial outlet and a pipe system connected to the inlet by means of an inlet pipe and an outlet.

U.S. Pat. No. 5,063,620, entitled Bath With Swirl Nozzles, which describes a spa having devices for generating jets of water and/or air, which can be directed into the spa from several positions.

U.S. Pat. No. 4,955,539, entitled Method and Apparatus for Converting Pressurized Low Continuous Flow to High Flow in Pulses, which describes a device and method for converting low continuous liquid flow to a high intermittent and pulsating flow.

U.S. Pat. No. 4,922,966, entitled Electrically Controllable 3-Way Valve that describes a known valve controllable by means of an electromagnetic including at least one spring installed with prestressing.

U.S. Pat. No. 4,896,384, entitled Discharge Nozzle for the Discharge Valve of a Whirlpool tub, which describes a nozzle for the discharge valve of a whirlpool having a water and air inlet duct.

U.S. Pat. No. 4,858,255, entitled Hydrotherapy Apparatus Having Preheated Air Agitation Feature, which describes an apparatus, provided with agitating air being preheated by the pump motor to avoid cooling.

U.S. Pat. No. 4,679,545, entitled Gas-Fired Outdoor Spa and Hot Tub Heater that describes a heat exchange unit for use with a spa or hot tub.

U.S. Pat. No. 4,542,854, entitled Whirlpool Jets, which describes a jet housing having a unitary combination orifice and directional flow that can be coupled and decoupled from the jet housing.

U.S. Pat. No. 4,419,141, entitled Cleaning Labyrinthine Systems with Foamed Solvent and Pulsed Gas which describes a channel system which may contain parallel channels and dead-end zones cleaned by flushing with a liquid solvent containing dispersed bubbles of suspended gas.

U.S. Pat. No. 4,364,751, entitled Self-Cleaning Pulsed Air Cleaner which describes an air cleaning method and apparatus in which air to be cleaned is drawn toward and through a filter.

U.S. Pat. No. 4,359,330, entitled Self-Cleaning Pulsed Air Cleaner with Integral Precleaner, which describes an air cleaning method and apparatus.

U.S. Pat. No. 4,331,459, entitled Self-Cleaning Pulsed Air Cleaner which describes an air cleaning method and apparatus in which air to be cleaned is drawn toward and through a filter.

U.S. Pat. No. 4,320,541, entitled Method and Apparatus For Providing a Pulsating Air/Water Jet that describes a Venturi type mixer that produces an aerated water jet for spas and is provided with pulsating action by means of an impeding spoiler that momentarily and repeatedly disturbs water jet.

U.S. Pat. No. 4,298,360, entitled Pulsed Air Filter Cleaning System, which describes a system for cleaning dust collecting filter bags with pulsed air.

U.S. Pat. No. 4,237,879, entitled Equipment Sets for the Sequential Administration of Medical Liquids at Dual Flow Rates Employing Parallel Secondary Liquid Tubing and a 3-Way Valve, which describes equipment sets wherein the primary liquid can be administered at a flow rate independent of the secondary liquid.

U.S. Pat. No. 4,139,001, entitled Hydro-Message and Pulsator Apparatus that describes a flexible mat having a plurality of protruding members and a plurality of apertures is agitated in a stream of highly turbulent mixture of air/water.

U.S. Pat. No. 4,119,686, entitled Hydro-Jet Fitting For Hot Tub, which describes a hydro-message jet fitting for a hot tub wherein the fitting includes a Venturi air-induction system.

U.S. Pat. No. 4,118,074, entitled Pulsed Air Activated Conveyer and System, which describes a system, that combines the principles of fluidizing gravity and a vibratory conveyor wherein the air is pulsed.

U.S. Pat. No. 3,989,063, entitled Electromagnetic 3-Way that describes an electro-magnetically actuated solenoid valve with two opposing valve seats between which the armature moves axially.

U.S. Pat. No. 3,970,111, entitled Electromagnetic 3-Way Arrangement, which describes an electromagnetic 3-way valve arrangement having two valves, each controlled by a separate armature of a single coil solenoid.

SUMMARY OF INVENTION

It is desirable to provide an apparatus capable of pulsing the water flow in a spa or similar device by controlling the air mixed with the water. It is also desirable to provide a control system that allows a user to control the desired pulse rate.

In this invention the blockage of air flow into the Venturi jet is accomplished by electrically or mechanically opening and closing an air valve. It is also desirable to provide a spa water pulsing system that permits a user to isolate various areas of the spa to allow pulsing water in some areas and non-pulsing water in other areas. This invention makes use of a novel three-way air control valve to increase the efficiency and cost effectiveness of the present preferred electrically controlled embodiment.

Accordingly, it is an object of the invention to provide an air control valve and system for pulsing and controlling the pulsing of water streams in a spa or jetted bath tub, which controls the pulsing of the water streams by permitting or blocking the intake of air into the Venturi jets.

Further it is an object of this invention to provide a system for controlling the pulsing of water streams in a spa or jetted bath which permits a user to selectpulsing water or non-pulsing water in one or more areas of the spa or bath.

Another object of this invention is to provide a multi source valve capable of controlling or changing the source of the airflow to a Venturi-type jet device.

It is a further object of this invention to provide a multi source air valve that is user selectable to add ambient or pulsed air to the water flow.

It is still another object of this invention to provide a control system that allows a user to set the desired pulse rate.

It is another object of this invention to provide a control system that has preset pulse rates.

A still further object of this invention is to provide a control system for hot tub spa jet flow control that makes use of a microprocessor controlled, preprogrammable user panel.

It is a still further object of this invention to provide a three or more way air valve adapted for use with hot tub spa equipment.

Another object of this invention is to provided a system for controlling the jetting of water streams in a hot tub spa, or the like, that minimizes the control devices required.

A still further object of this invention is to provide a multi-source air valve for use with Venturi-jets used hot tub spas and the like.

It is another object of this invention to provide a hot tub spa system that makes use of a multi-source air valve in combination with Venturi-type jets to vary pulse rates in different parts of the spa.

In one embodiment of this invention, it is an object to provide a system for controlling the pulsing of water streams using that makes use of water pressure to open and close air access, or select the source of air, to a Venturi-like jet.

Additional objects, advantages, and other novel features of the various embodiments of this invention will be set forth in part in the description that follows and in part will become apparent to those skilled in the art upon examination of the following or may be learned with the practice of the invention. The objects and advantages of this invention may be realized and attained by means of the steps and combinations particularly pointed out in the appended claims. Still other objects of the invention will become readily apparent to those skilled in the art from the following description, wherein there is shown and described various embodiments of this invention, simply by way of illustration of some of the best modes suited to carry out this invention. As will be realized, this invention is capable of other different embodiments, and its several details, and specific steps, are capable of modification in various aspects without departing from the invention. Accordingly, the objects, drawings, and descriptions should be regarded as illustrative in nature and not as restrictive.

BRIEF DESCRIPTION OF DRAWINGS

The accompanying drawings incorporated in and forming a part of the specification, illustrate a preferred embodiment of the present invention. Some, although not all, alternative embodiments are described in the following description. In the drawinggs.

Figure 1A:
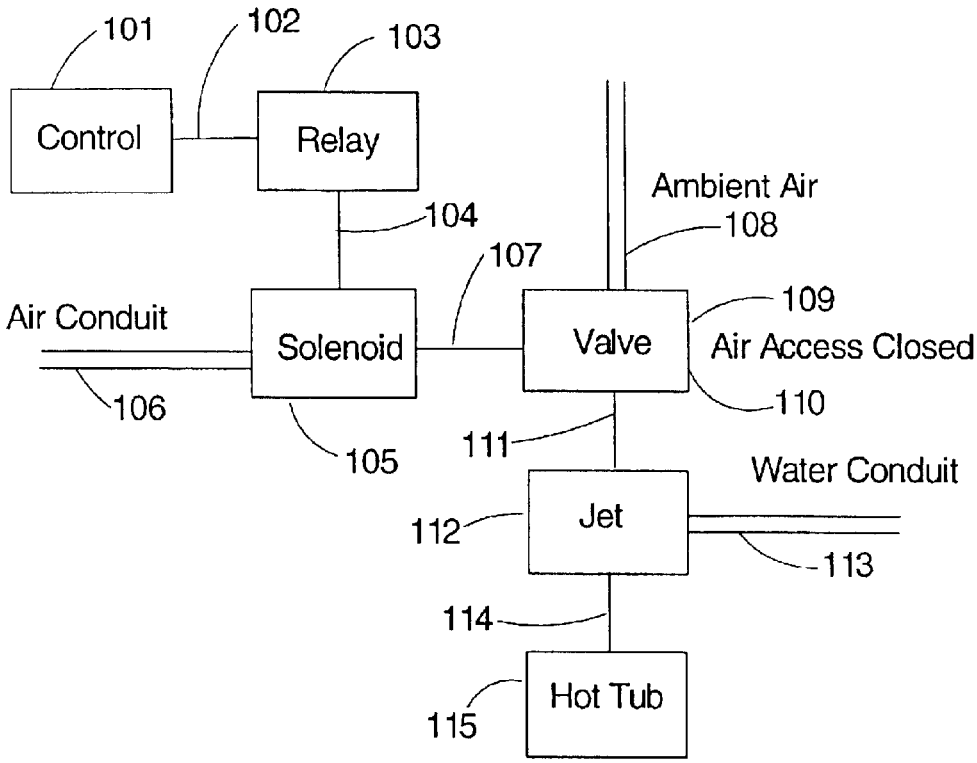
FIG. 1A is a system diagram showing the preferred components and connections of the system of this invention, using electrical controls.

Reference will now be made in detail to the present preferred embodiment of the invention, an example of which is illustrated in the accompanying drawings.

DETAILED DESCRIPTION

Venturi-type jets are widely used in many applications from spas to carburetors for internal combustion engines. The most common use of a Venturi-type is to mix liquids and gases together. A typical Venturi-type has two openings, one for input and the other for output of a gas or liquid. The interior of the valve is generally constricted near the middle to create higher pressure on one side and a vacuum effect on the other. A third opening is located near the vacuum side of the valve and uses the vacuum effect to mix a liquid or a gas with the liquid or gas already flowing through the valve. In a spa, a Venturi-type jet is used to mix air to water, thus providing a stronger pressurized jet below the water surface as the jetted water enters the tub of the spa to provide a therapeutic massage.

In general, the function of a Venturi-type jet in hot tubs or spas is as follows. As the stream of water flows through the constricted portion of the Venturi-type pressure within the chamber is reduced drawing in air from the provided air opening. The combined air and water mixture is thereafter forced into the main body of water in the hot tub spa with more force than if water alone were injected into the hot tub spa. For many years spa manufacturers have attempted to create more therapeutic spas by using jets that move in a variety of ways rather than simply squirting out a single stream of water. Some of these jets include gattling jets, spinning jets and jets that can be changed from spinning into stationary jets. Recently, some spa manufacturers have attempted to cause the jets to pulsate by placing valves behind the Venturi jets and opening and closing the valves through the use of programmed circuits and relays. All previously known techniques for causing the jets to pulsate have involved alternatively shutting off or opening up the water flow to the jet. This approach has a number of inherent problems, including failures caused by excessive backpressure. Also, previous technology severely limited the spa user's ability to control the jetting of the water flow into the hot tub. Now, with this invention the jetting of water is easily controllable by the user in either a programmable or pre-programmed manner by making use of modern water proof touch sensitive panels and microprocessor controls. Moreover, with this new invention, in its present preferred embodiment, the jetting of the water stream is pulsed by the user's selection of pulsed air. Alternatively, the user can select ambient (non-pulsed) air, which provides a steady high velocity jetted stream, or no air, which significantly lowers the velocity of the jetted stream in to the spa. By permitting the user to select pulsing air, non-pulsing air or no air, this invention provides the user with a more therapeutic massage. Moreover, pulsed air, which can be provided to the Venturi-type jet valve, of this invention is controlled be the user's selection of either a pre-programmed pulsing pattern or a user programmed pulsing pattern, via a control panel in communication with a microprocessor controller. The microprocessor controller, furthermore, controls the opening and closing of a solenoid, which permits or stops the flow of air to the air selection valve, and if pulsed air is selected, pulses the air to the Venturi-type jet. In this invention the water flow continues, although the force of the water stream is substantially reduced, when pulsed, selected off (that is when the air access is blocked). Also, in the present preferred embodiment of this invention, the user interface is built into the top portion of the spa, although in alternative embodiments the user interface may be a separate control panel or even a wireless remote control device. Because of the temperature and water environment, the preferred user interface is a waterproof touch pressure panel device. In the present embodiment, the user interface is also provided with LED lights or LCDs to display the status of the hot tub spa. Such status typically includes jet status (pulsating, spinning, gattling, stationary, and the like), water temperature, and error status. In the present embodiment, once the user selects, using the user interface, a pulsing mode for the pulsed air flow, the microprocessor reading the user input, activates a relay, which controls a preferably direct operating solenoid operated valve. The valve is alternatively turned to open and closed to pulse air to the air source selector valve, and thereby to one or more Venturi-type jets. In an alternative embodiment the pulsing of the air to the Venturi-type jets is accomplished by blocking the air using a water driven motor that opens the air control valve. Previously available systems did no provide the user with control of the airflow to the Venturi-type jets. While this invention permits a user to not only select whether pulsing jets are desirable for a particular seat position, this invention also allows a user to program or select the pulsing pattern of the jets. By providing an air source selection valve with a diverter, this invention minimizes the cost and maximizes the reliability of the air solenoid, which pulses the air, by permitting as few one-air solenoid to control the pulsing for all Venturi-type jets of the spa. In alternative embodiments, multiple air solenoids can be used to provide separate pulsing patterns to different jets in the spa. In sum, in this present embodiment of this invention the use of this three-way air valve facilitates the control of pulsing of the jets with a minimum of required solenoids. As noted above, in alternative embodiments, multiple solenoids can be employed within the scope of this invention to provided additional jet control flexibility. The following description and drawings provide additional details of this present mode of this invention.

FIG. 1A shows a system diagram showing the preferred components and connections of the system of this invention, using electrical controls. A user control 101 is in electronic communication 102 with a relay 103. The relay 103, in communication with a solenoid 105, when activated opens the solenoid 105, thereby pulsing air from an air conduit 106, to a pulsed air conduit 107. The pulsed air conduit 107 is connected to an air selection valve 109. The air selection valve 109, provided with a user selection switch or knob as shown in FIGS. 2A, 2B, 2C, 4 and 5, permits the user to select, in the present embodiment, either a flow of pulsed air, from the pulsed air conduit 107; ambient or non-pulsed air 108, or the blockage of air 110. A selected air conduit 111 connects the selected air from the air selection valve 109 to one or more Venturi-like jets 112. The Venturi-like jets 112 receive a flow of water 113 as well as the provided air from the selected air conduit 111. Within the Venturi-like jet a diminished internal diameter region increases the velocity of the received water and thereby creates a vacuum, which in turn draws the available air into the Venturi-like jet. The combination of drawn air and water is expelled in a high velocity air-water combination 114 to the interior of the hot tub spa 115.

The present control 101 is a microprocessor controller with a generally waterproof, touch or pressure sensitive control panel for input, a display device for displaying status, control information and, in some embodiments, help menus to the user. Typically, the microprocessor controller also includes one or more storage devices, a power supply/regulator and a battery. The relay 103 is typical electro-mechanical relay device. The preferred solenoid 105 is a high response speed capable DC air control solenoid valve. The present preferred air selection valve 109 is shown and described in further detail in FIGS. 2A, 2B and 2C. The jet devices 112 can be standard jets, gattling jets, spinning jets and jets that can be changed from spinning to stationary jets and whirlpool jets among others. The hot tub spa 115 of this invention is a standard hot tub spa shell, or jetted bath, along with the standard hot tub spa components, fittings, seals, and fixtures with the addition of the necessary components and conduits as further described herein.

Figure 1B:
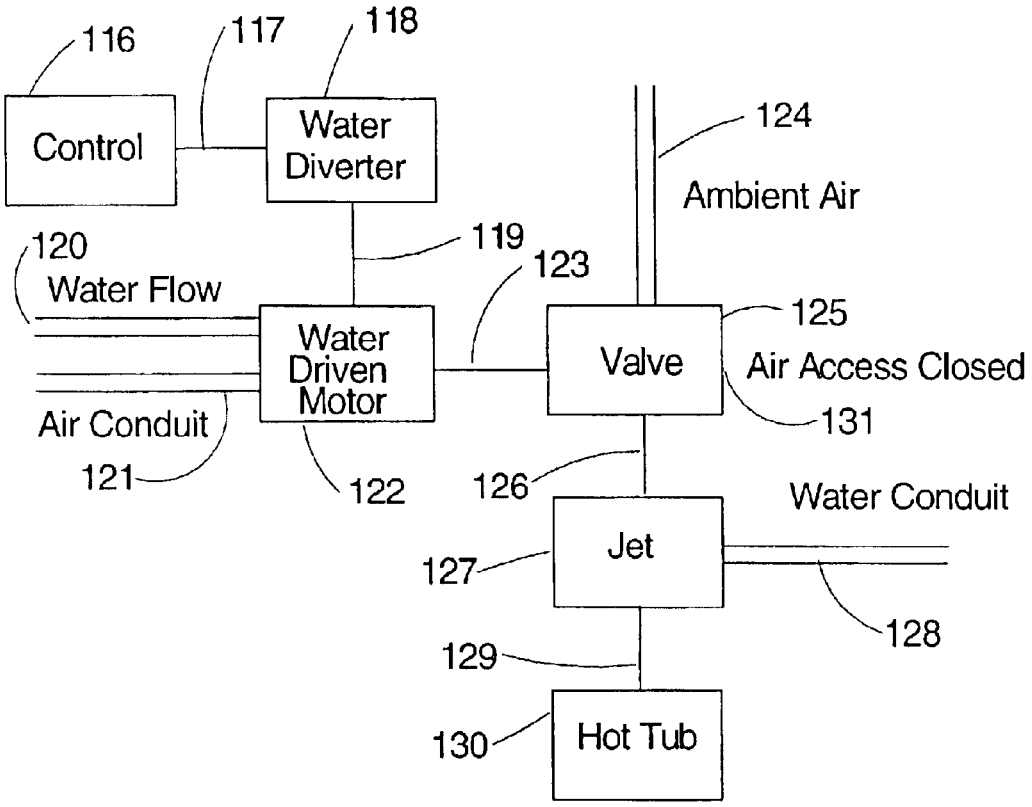
FIG. 1B is a system diagram showing the preferred components and connections of the system of this invention, using mechanical controls.

FIG. 1B shows a system diagram showing the preferred components and connections of the system of this invention using mechanical controls. A user control 116 is in mechanical communication 117 with a water diverter 118. The water diverter 118 can be selected to permit a flow of water 120 to a water driven motor 122. A water diverter 118 can be as simple as a standard faucet valve, where the control 116 may be a simple knob. Mechanical communication 119 between the water diverter 118 and the water driven motor 122 may, in some embodiments be a post connected to shut-off gate device, which when closed refuses to allow the water flow 120 to enter the water driven motor 122. The water driven motor 122, in some embodiments, operates by placing a propeller device within the flow of water in the motor 122. The propeller device is spun by motion of the flow of water in the motor. The propeller is mechanically connected to shut-off linkage, which in turn opens and alternatively closes air conduit flow 121 through the water driven motor 122, or alternatively directly opens and closes air access to the air selection valve 125. By alternatively opening and closing the air conduit flow 121 out of the motor 122 pulsed air 123 is provided to an air selection valve 125, or in the alternative opening and closing the air selection valve 125 pulsed air is provided from the air selection valve 125. The air selection valve 125, provided with a user selection switch or knob as shown in FIGS. 2A, 2B, 2C, 4 and 5, permits the user to select, in the present embodiment, either a flow of pulsed air, from the pulsed air 123 (or in the alternative, air pulsed by the water driven motor 122); ambient or non-pulsed air 124, or the blockage of air 131. A selected air conduit 126 connects the selected air from the air selection valve 125 to one or more Venturi-like jets 127. The Venturi-like jets 127 receive a flow of water 113 as well as the provided air from the selected air conduit 126. Within the Venturi-like jet a diminished internal diameter region increases the velocity of the received water and thereby creates a vacuum, which in turn draws the available air into the Venturi-like jet. The combination of drawn air and water is expelled in a high velocity air-water combination 129 to the interior of the hot tub spa 130.

The present control 101 is a microprocessor controller with a generally waterproof, touch or pressure sensitive control panel for input, a display device for displaying status, control information and, in some embodiments, help menus to the user. Typically, the microprocessor controller also includes one or more storage devices, a power supply/regulator and a battery. The relay 103 is typical electro-mechanical relay device. The preferred solenoid 105 is a high response speed capable DC air control solenoid valve. The present preferred air selection valve 109 is shown and described in further detail in FIGS. 2A, 2B and 2C. The jet devices 112 can be standard jets, gattling jets, spinning jets and jets that can be changed from spinning to stationary jets and whirlpool jets among others. The hot tub spa 115 of this invention is a standard hot tub spa shell, or jetted bath, along with the standard hot tub spa components, fittings, seals, and fixtures with the addition of the necessary components and conduits as further described herein.

Figure 2A:
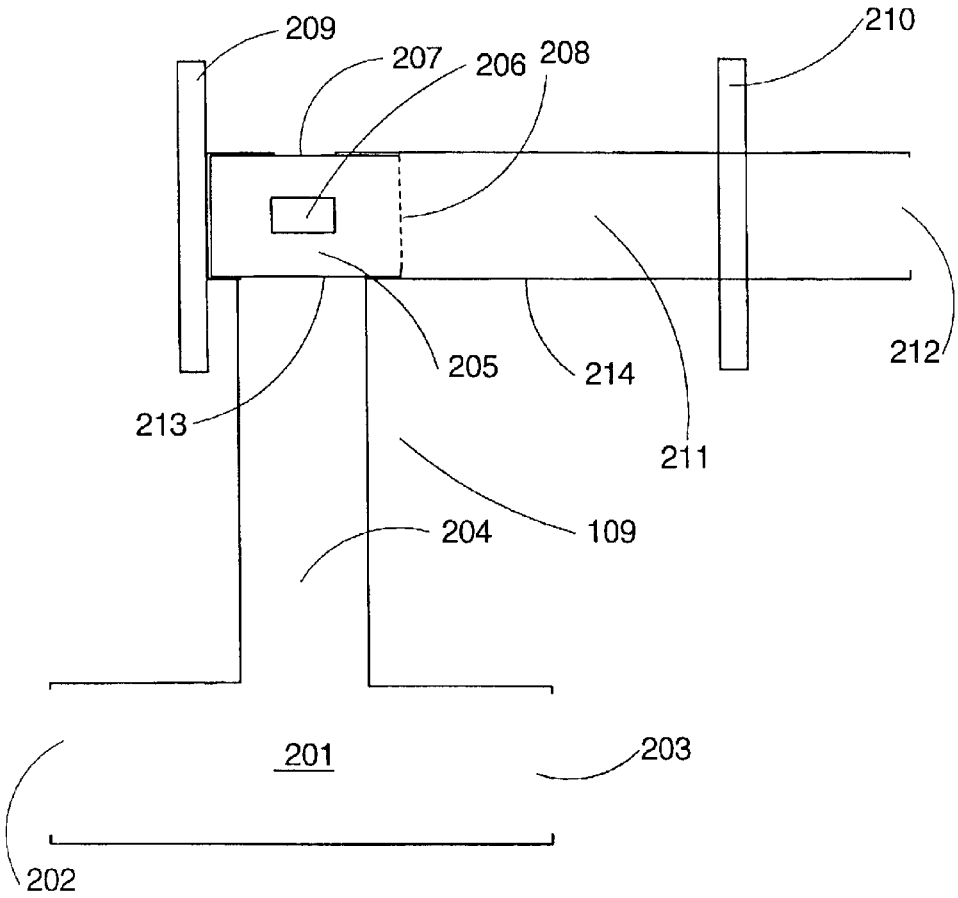
FIG. 2A is a side partial cut-away view of the preferred air valve of this invention with airflow selection set to No Air Flow.
Figure 2B:
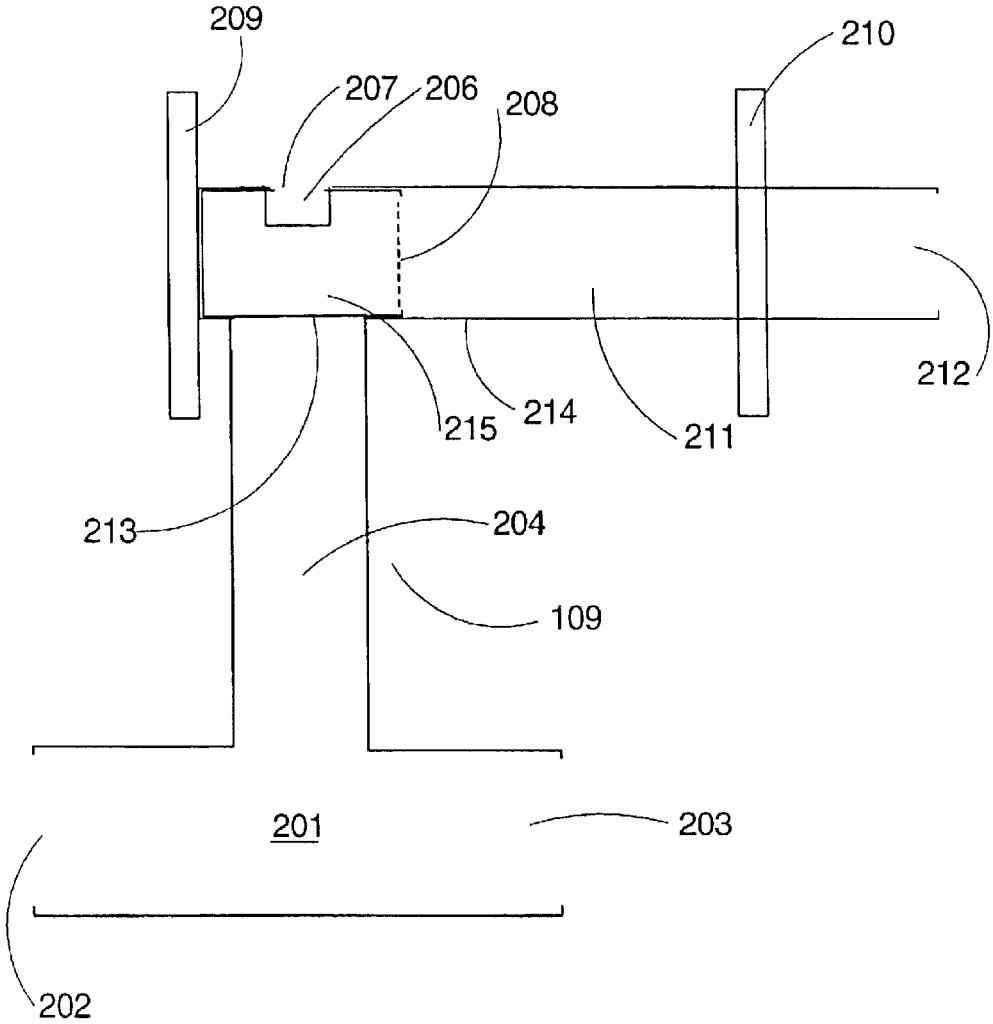
FIG. 2B is a side partial cut-away view of the preferred air valve of this invention with airflow selection set to ambient (non-pulsed) air.
Figure 2C:
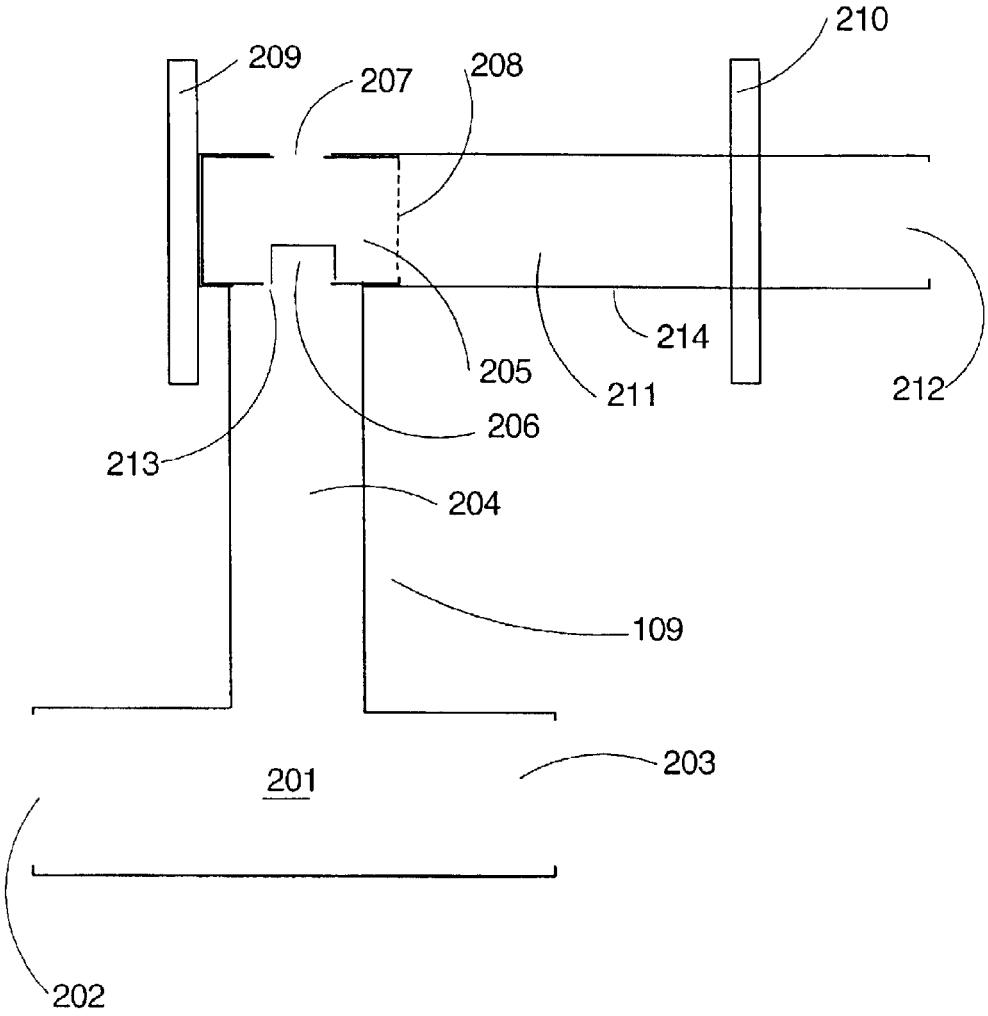
FIG. 2C is a side partial cut-away view of the preferred air valve of this invention with airflow selection set to pulsed air.

FIG. 2A shows a side partial cut-away view of the preferred air selection valve 109 of this invention with the airflow selection switch 205 set to No Air Flow. This valve 109 has an air through piece 201, having a first opening 202 and a second opening 203. The first opening 202 and the second opening 203 are provided to form connections with the pulsed air 107 from the solenoid 105. Forming a T with the air through piece 201 is a pulse air input conduit 204 at the opposite end thereof is an opening 213 for air communication to the valve switch 205. The present valve switch 205 includes a knob 209 fixed to a cylindrical portion 208 with an opening 206 in the cylindrical portion 208. As the knob 209 is turned the position of the opening 206 moves from being aligned to the side wall 214 of the exit conduit 211, as shown in this FIG. 2A, in which position air flow to the exit conduit 211 is blocked, to align with either the opening 213 from the pulse air input conduit 204, as shown in FIG. 2C, in which position pulsed air flow is permitted from the pulsed air input conduit 204 to the exit conduit 211, or to align with the ambient air 108 opening 207, as shown in FIG. 2B, in which position non-pulsed air flow is permitted from the ambient air 108 to the exit conduit 211. In alternative embodiments of this invention the selection blocking air may not necessarily be provided. The exit conduit 211 terminates with an exit opening 212, which is adapted to be fixed to the selected air conduit 111, which provides air to the Venturi-like jet 112. In the present embodiment, to facilitate the fixing of the air selection valve 109 to the selected air conduit 211 a screw mount fitting 210 is provided. In other alternative embodiments, the exit opening 212 is joined to the selected air conduit 211 through other typical pluming techniques.

The present embodiment of the air selection valve 109 is manufactured from injection molded or fiber wound ABS plastic. Although in alternative embodiments, this valve 109 can be manufactured using any other typical pluming materials, including metal, composites and/or wire wrapped synthetics.

FIG. 2B shows a side partial cut-away view of the preferred air selection valve 109 of this invention with the air flow selection switch 205 to align the opening 206 in the cylindrical portion 208 of the valve switch 205 with the ambient (non-pulsed) air 108 opening 207.

FIG. 2C shows a side partial cut-away view of the preferred air selection valve 109 of this invention with air flow selection switch 205 set to align the opening 206 in the cylindrical portion 208 of the valve switch 205 with the pulsed air input conduit 204 opening 213.

Figure 3:
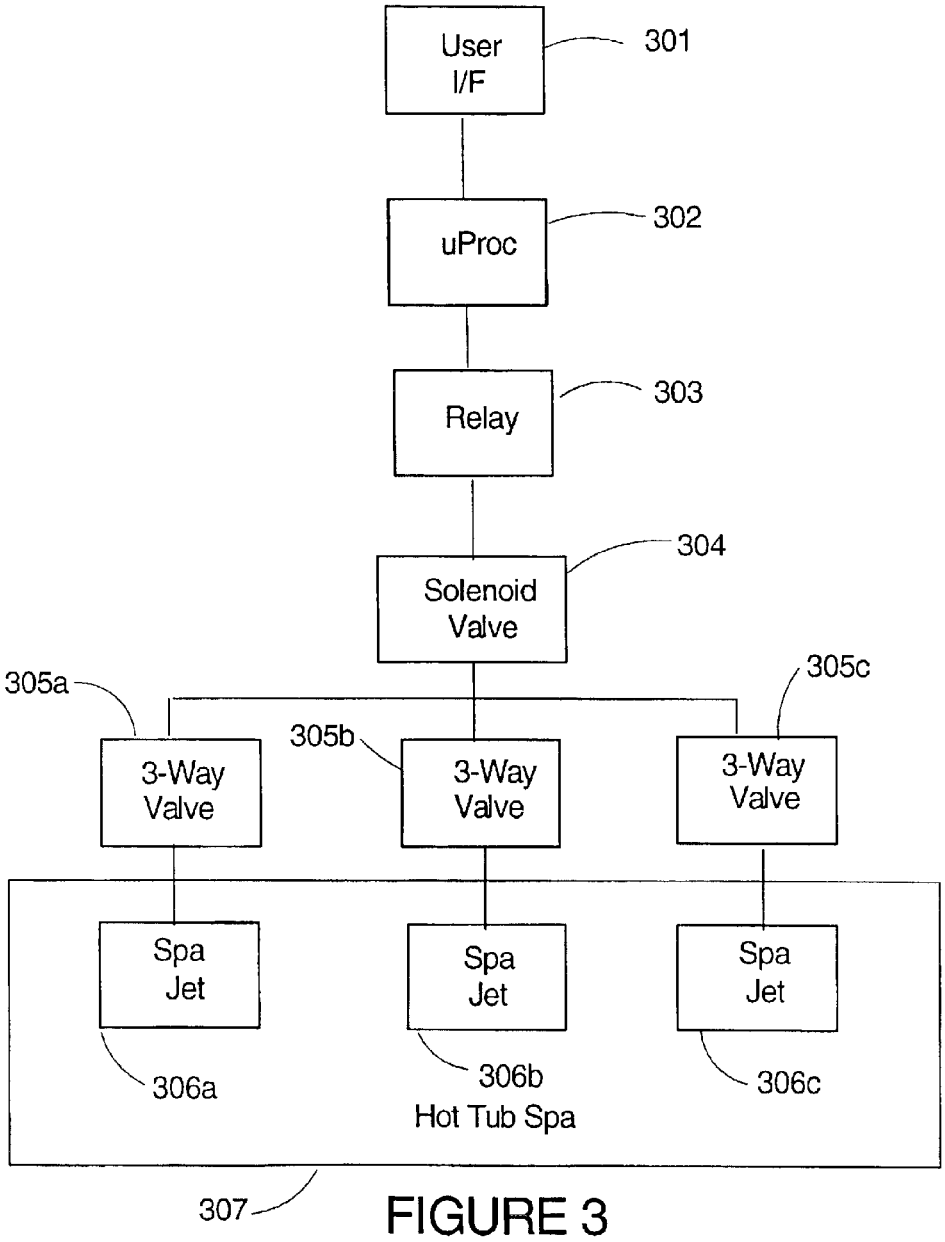
FIG. 3 is a functional block diagram of the preferred functional components of the preferred embodiment of this invention.

Referring to FIG. 3, which shows a functional block diagram of the present functional components of the preferred embodiment of the invention, a user interface 301, a programmable microprocessor 302, an electrical relay 303, and a solenoid-controlled valve 304 is shown. User interface 301 allows a user to set the desired pulse rate of the Venturi-type system. User interface 301 may have an indicator that shows the on or off status of the system. User interface 301 may also have a display that shows the number of seconds in the pulse rate. This display may be an LED, LCD or any other suitable means. Typically and preferably the user interface 301 is constructed in a manner that is water proof or at least water resistant. In one embodiment, the desired pulse rate is fed to a programmable microprocessor 302 via the user interface 301. The microprocessor 302 communicates to the rest of the control system the pulse rate. In another embodiment, the user selects from pulse rates that are preprogrammed into programmable microprocessor 302. An electric relay 303 is activated by programmable microprocessor 302, and in turn controls the solenoid valve 304. In some embodiments of the invention, multiple solenoid valves are employed. Typically, these solenoid valves are direct operating solenoids.

Again referring to FIG. 3, it can be seen that a single solenoid valve controls any number of required 3-way or multiple-way air selection valves 305*a,b,c*, etc. In one embodiment, the single solenoid valve 304 may be used to control the pulsing of the air for all of the 3-way valves 305*a,b,c*. By opening and closing the solenoid valve 304 the release and restriction of airflow is provided, thereby, allowing for the desired a pulse action. This is accomplished without interrupting the flow of water through the valves. This is a significant improvement over earlier systems that created a pulse by blocking the water flow while keeping the airflow constant, which earlier systems cause a great deal of stress on the valves. Pulsing the airflow and keeping the water flow constant exerts very little pressure on the valves. The three-way air control valves 305*a,b,c* each provide air to one or more spa jets 306*a,b,c*. The typical spa jets 306*a,b,c* include a Venturi-like section and a jet exit section which is fixed in place in the hot tub spa 307.

Figure 4:
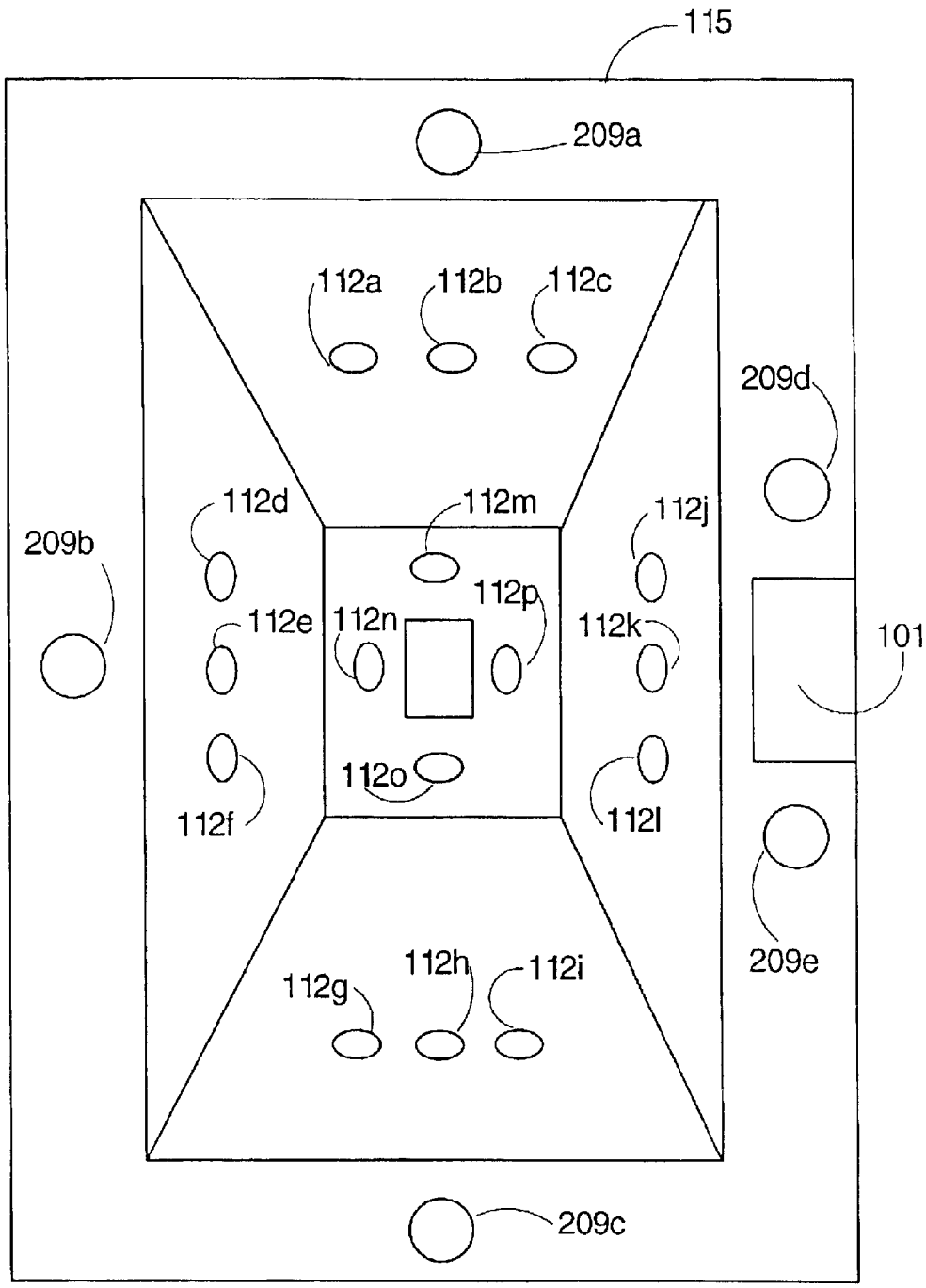
FIG. 4 is a diagram view of the exterior of a traditional spa hot tub with the preferred components of the preferred embodiment of this invention.

FIG. 4 shows a diagram view of the exterior of a traditional spa hot tub with the preferred components of the preferred embodiment of this invention. Another major improvement over existing systems is the ability to have different pulse rates at different locations in a spa or hot tub 115. FIG. 4 shows a four-person spa, but this would also be true for any size spa or hot tub. Referring to FIG. 4, the location of the 3-way air selection valves is located generally under or below the knobs 209*a–e*, which are shown on the top surface of the hot tub spa 115. This FIG. 4 also shows the placement of the air-water jet exit sections 112*a–p*. In this embodiment, an air selection valve 109 (shown in FIGS. 1, 2A, 2B and 2C) is provided for the jets 112 for each sitting position. For example, the air selection valve 109, connected to the knob 209*a*, controls the airflow to the jets 112*a–c*. Also, in this FIG. 4 a typical user interface control panel 101 is shown on the top surface of the hot tub spa 115.

Figure 5:
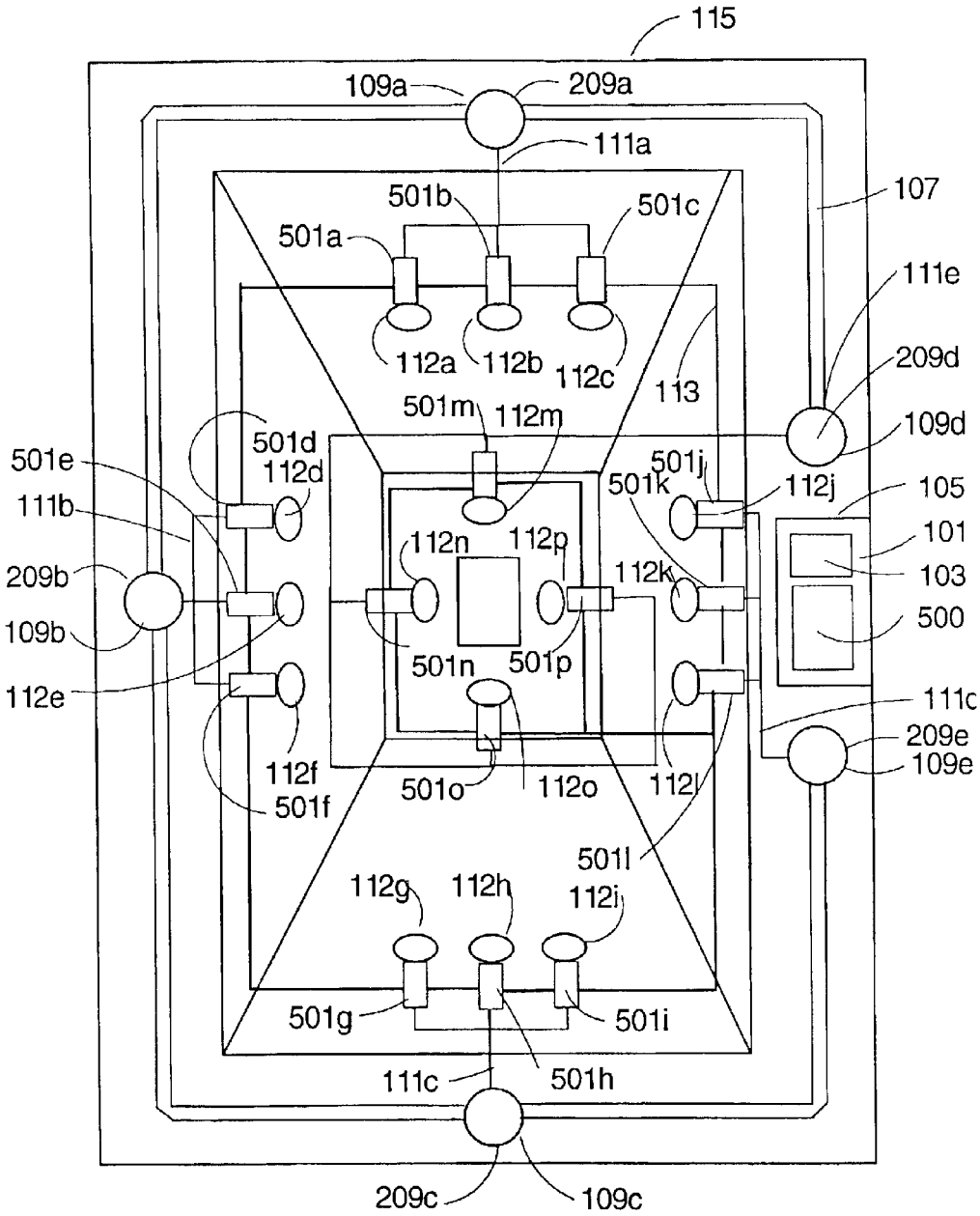
FIG. 5 is a diagram view of the traditional spa hot tub showing the internal components of the preferred embodiment of the invention.

FIG. 5 shows a diagram view of the traditional spa hot tub displaying the internal components of the preferred embodiment of the invention. This view shows the pulsed air conduit 107 in air communication with each of the air control selection valves 109*a–e*, the knobs 209*a–e* of which alone are shown here, with the other air control selection valve components, as described above, fixed to and positioned below the knobs 209*a–e*. The selected air conduits 111*a–e* are shown providing an air communication channel from the air selection control valves 109*a–e*. The Venturi-like sections 501*a–p* are shown connected to the selected air conduits 111*a–e*. The water conduit 113 is also shown providing water to the Venturi-like sections 501*a–p*. The user controller 101 is shown with the processor 500 in communication with a relay 103, which is in electronic communication with the solenoid 105, which controls the flow of pulsed air 107.

The foregoing description of the present embodiment of the invention has been presented for the purposes of illustration and description of the best mode of the invention currently known to the inventors. It is not intended to be exhaustive or to limit the invention to the precise form disclosed. Obvious modifications or variations are possible and foreseeable in light of the above teachings. This embodiment of the invention was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when they are interpreted in accordance with the breadth to which they are fairly, legally, and equitable entitled.

What is claimed is:

1. An apparatus for spa air control comprising:

(A) an air through piece with an exterior and an interior wall;

(B) a first opening for receiving pulsed air in said air through piece;

(C) an opening for exiting selected air from said air through piece;

(D) an exit conduit having an opening for receipt of ambient air and an opening for exit selected air; and (E) an air flow selection switch, fitted within said exit conduit for selecting an opening from either said opening for exiting selected air or said opening for receipt of ambient air.

2. The apparatus of claim 1, wherein said air flow selection switch further comprises:

(1) a knob;

(2) a cylindrical portion fixed to said knob; and (3) an opening in said cylindrical portion.

3. The apparatus of claim 2, wherein said knob of said air flow selection switch is turnable to align said opening in said cylindrical portion to said opening for receiving pulsed air.

4. The apparatus of claim 2, wherein said knob of said air flow selection switch is turnable to align said opening in said cylindrical portion to said opening for receipt of ambient air.

5. The apparatus of claim 1, wherein said air flow selection switch further comprises a second opening in said air through piece for conveying received pulsed air to an air conduit.

6. A system for controlling the jetting of an air-water flow into a hot tub spa, comprising:

(A) a controller;

(B) a relay in electronic communication with said controller;

(C) a solenoid controlled by said relay, said solenoid receiving air and capable of producing pulsed air;

(D) an air selection valve receiving pulsed air from said solenoid and ambient air and producing a selected air flow; and (E) a jet device receiving said selected air flow and a water flow and capable of producing an accelerated air-water flow and wherein said jet device is mountable in a hot tub spa.

7. A system for controlling the jetting of an air-water flow into a hot tub spa, as recited in claim 6, wherein said controller further comprises:

(1) a microprocessor;

(2) a user interface in electronic communication with said microprocessor; and (3) a display in electronic communication with said microprocessor.

8. A system for controlling the jetting of an air-water flow into a hot tub spa, as recited in claim 7, wherein said user interface is a water-resistant touch sensitive device.

9. A system for controlling the jetting of an air-water flow into a hot tub spa, as recited in claim 6, wherein said solenoid further comprises a DC air switch solenoid valve.

10. A system for controlling the jetting of an air-water flow into a hot tub spa, as recited in claim 6, wherein said air selection valve further comprises:

(1) an air through piece with an exterior and an interior wall;

(2) a first opening for receiving pulsed air in said air through piece;

(3) an opening for exiting selected air from said air through piece;

(4) an exit conduit having an opening for receipt of ambient air and an opening for exit selected air; and (5) an air flow selection switch, fitted within said exit conduit for selecting an opening from either said opening for exiting selected air or said opening for receipt of ambient air.

11. The system of claim 10, wherein said air flow selection switch further comprises:

(a) a knob;

(b) a cylindrical portion fixed to said knob; and (c) an opening in said cylindrical portion.

12. The system of claim 10, wherein said air flow selection switch further comprises a second opening in said air through piece for conveying received pulsed air to an air conduit.

13. The system of claim 10, wherein said knob of said air flow selection switch is turnable to align said opening in said cylindrical portion to said opening for receiving pulsed air.

14. The system of claim 10, wherein said knob of said air flow selection switch is turnable to align said opening in said cylindrical portion to said opening for receipt of ambient air.

15. The system of claim 10, wherein said jet device further comprises a Venturi device for receiving air and combining said received air with received water and which outputs an air-water jetted flow.

* * * * *